US005084194A

United States Patent [19]

Doner et al.

[11] Patent Number: 5,084,194

[45] Date of Patent: Jan. 28, 1992

[54] GREASE COMPOSITION

[75] Inventors: John P. Doner, Sewell; Andrew G. Horodysky, Cherry Hill; John A. Keller, Jr., Pitman, all of N.J.

[73] Assignee: Mobil Oil Corporation, Fairfax, Va.

[21] Appl. No.: 614,564

[22] Filed: Nov. 14, 1990

Related U.S. Application Data

[63] Continuation of Ser. No. 14,091, Jan. 28, 1987, abandoned, which is a continuation of Ser. No. 861,738, May 7, 1986, abandoned, which is a continuation of Ser. No. 774,873, Sep. 12, 1985, abandoned, which is a continuation of Ser. No. 641,077, Aug. 15, 1984, abandoned, which is a continuation-in-part of Ser. No. 587,328, Mar. 7, 1984, abandoned.

[51] Int. Cl.[5] ..... C10M 117/04; C10M 139/00

[52] U.S. Cl. ..... 252/32.7 E; 252/41; 252/49.6

[58] Field of Search ..... 252/32.7 E, 496

[56] References Cited

U.S. PATENT DOCUMENTS

| | | | |
|---|---|---|---|
| 2,053,474 | 9/1936 | Graves et al. | 260/98 |
| 2,397,956 | 4/1946 | Fraser | 252/41 |
| 2,450,220 | 9/1948 | Ashburn et al. | 252/41 |
| 2,703,784 | 3/1955 | Fields | 252/32.7 |
| 2,703,785 | 3/1955 | Roberts et al. | 252/33.4 |
| 2,813,830 | 11/1957 | Trautman | 252/49.6 |
| 2,815,325 | 12/1957 | Pohorilla et al. | 252/42.1 |
| 2,905,644 | 9/1959 | Butter | 252/392 |
| 2,943,054 | 6/1960 | Worth | 252/40.7 |
| 2,975,134 | 3/1961 | Cook | 252/40.7 |
| 3,009,791 | 11/1961 | Emrick | 44/63 |
| 3,012,968 | 12/1961 | Emrick et al. | 252/49.6 |
| 3,095,375 | 6/1963 | Pitman | 252/28 |
| 3,125,523 | 3/1964 | Siegart et al. | 252/33.6 |
| 3,125,524 | 3/1964 | Siegart et al. | 252/33.6 |
| 3,125,525 | 3/1964 | Siegart et al. | 252/33.6 |
| 3,158,574 | 11/1964 | Greenwood et al. | 252/36 |
| 3,224,971 | 12/1965 | Knowles et al. | 252/46.3 |
| 3,361,672 | 1/1968 | Andress et al. | 252/49.6 |
| 3,446,808 | 5/1969 | Cyba | 260/250 |
| 3,625,899 | 12/1971 | Sawyer | 252/75 |
| 3,697,574 | 10/1972 | Piasek | 260/462 R |
| 3,704,308 | 11/1972 | Piasek et al. | 260/462 R |
| 3,711,411 | 1/1973 | Sawyer et al. | 252/78 |
| 3,711,412 | 1/1973 | Sawyer et al. | 252/78 |
| 3,736,357 | 5/1973 | Piasek et al. | 260/570.5 P |
| 3,751,365 | 8/1973 | Piasek et al. | 252/49.6 |
| 3,758,407 | 9/1973 | Harting | 252/18 |
| 3,923,712 | 12/1975 | Vickery | 260/28.5 B |
| 4,016,092 | 4/1977 | Andress | 252/32.5 |
| 4,071,548 | 1/1978 | Okamoto | 260/462 R |
| 4,097,389 | 6/1978 | Andress | 252/51.5 A |
| 4,140,492 | 2/1979 | Feldman et al. | 44/62 |
| 4,159,957 | 7/1979 | deVries | 252/33.4 |
| 4,182,823 | 1/1980 | Schoenberg | 526/298 |
| 4,244,829 | 1/1981 | Coupland et al. | 252/56 R |
| 4,317,739 | 3/1982 | Spence | 252/47.5 |
| 4,328,113 | 5/1982 | Horodysky et al. | 252/49.6 |
| 4,370,248 | 1/1983 | Horodysky et al. | 252/49.6 |
| 4,374,032 | 2/1983 | Gemmill et al. | 252/49.6 |
| 4,376,712 | 3/1983 | Horodysky et al. | 252/49.6 |
| 4,382,006 | 5/1983 | Horodysky | 252/49.6 |
| 4,389,322 | 6/1983 | Horodysky | 252/49.6 |
| 4,394,278 | 7/1983 | Horodysky et al. | 252/46.3 |
| 4,402,842 | 9/1983 | Horodysky et al. | 252/47.5 |
| 4,406,802 | 9/1983 | Horodysky et al. | 252/49.6 |
| 4,410,438 | 10/1983 | Horodysky | 252/49.6 |
| 4,426,305 | 1/1984 | Malec | 252/49.6 |
| 4,440,656 | 4/1984 | Horodysky | 252/49.6 |
| 4,472,289 | 9/1984 | Horodysky et al. | 252/49.6 |
| 4,486,321 | 12/1984 | Horodysky et al. | 252/46.3 |
| 4,524,005 | 6/1985 | Horodysky | 252/49.6 |
| 4,529,529 | 7/1985 | Horodysky | 252/49.6 |
| 4,582,617 | 4/1986 | Doner et al. | 252/32.7 |
| 4,743,386 | 5/1988 | Doner et al. | 252/496 |
| 4,780,227 | 10/1988 | Doner et al. | 252/32.7 E |
| 4,828,732 | 5/1989 | Doner et al. | 252/32.7 E |
| 4,961,868 | 10/1990 | Doner et al. | 252/32.7 |

FOREIGN PATENT DOCUMENTS

| | | |
|---|---|---|
| 711234 | 6/1965 | Canada . |
| 0067002 | 12/1982 | European Pat. Off. . |
| 0075478 | 3/1983 | European Pat. Off. . |
| 0134063 | 3/1985 | European Pat. Off. . |
| 1256826 | 12/1967 | Fed. Rep. of Germany . |
| 1400020 | 7/1975 | United Kingdom . |
| 2102023 | 1/1983 | United Kingdom . |
| 2103651 | 2/1983 | United Kingdom . |
| 2106133 | 4/1983 | United Kingdom . |
| 2107734 | 5/1983 | United Kingdom . |
| 2125431 | 3/1984 | United Kingdom . |

OTHER PUBLICATIONS

Chevron Bulletin, "Grease-The Oldest Lubricant Known", pp. 8-9 (1976).

Smalheer et al., "Lubricant Additives", 1967 Chap. 1.

C. J. Boner, "Manufacture and Application of Lubricating Greases", 1954, pp. 435-437, 497-498, 157.

C. V. Smalheer & R. K. Smith, "Lubricant Additives", 1967, Section 1, pp. 1-11. Chapter 1.

G. G. Hawley, "The Condensed Chemical Dictionary", Ninth Edition, pp. 520 and 938.

*Primary Examiner*—Prince Willis, Jr.
*Assistant Examiner*—Ellen McAvoy
*Attorney, Agent, or Firm*—Alexander J. McKillop; Charles J. Speciale; Jessica M. Sinnott

[57] ABSTRACT

Grease compositions, wherein the grease is thickened with a metal hydroxy-containing soap grease thickener are provided. Other essential ingredients of the compositions include borated hydrocarbylamines.

2 Claims, No Drawings

GREASE COMPOSITION

This is a continuation of Ser. No. 14,091, filed on Jan. 28, 1987, now abandoned, which is a continuation of Ser. No. 06/861,738, filed on May 7, 1986, now abandoned, which is a continuation of Ser. No. 06/774,873, filed on Sept. 12, 1985, now abandoned, which is a continuation of Ser. No. 06/641,077, filed on Aug. 15, 1984, now abandoned, which is a continuation-in-part of Ser. No. 06/587,328, filed on Mar. 7, 1984, now abondoned.

BACKGROUND OF THE INVENTION

1. Field of the Invention

The invention is concerned with a novel group of compositions. It more particularly relates to a synergistic grease composition comprising oil, hydroxy-containing soap thickener and borated amine, and optionally containing phosphorus and sulfur moieties.

2. Discussion of the Prior Art

Greases thickened with metal hydroxystearates, specifically lithium hydroxystearates, are well known, as is the use of "additive packages". These packages are known to contain phosphorous and sulfur compounds as well as other additives that impart antioxidant, detergent, dispersant, etc. properties to such greases.

Form U.S. Pat. No. 4,328,113 it is also known that borated amines, such as borated hydrocarbyl mono-and diamines, are useful as friction reducers in lubricants, especially in lubricating oils. However, no prior art is known that teaches or suggests the unexpected results obtained by combining the known additive packages mentioned herein with the particular thickener and the borated amines of the invention.

SUMMARY OF THE INVENTION

In accordance with the invention, there is provided an improved grease composition comprising a major proportion of a grease and a minor amount of a compound prepared by reacting an amine of the formula

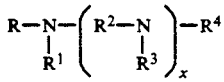

wherein x is 0 or 2, R, $R^1$, $R^3$ and $R^4$ are hydrogen or a $C_1$ to $C_{30}$ hydrocarbyl groups, including alkyl groups containing 6 to 20 carbon atoms, hydroxyalkyl groups containing 2 to 4 carbon atoms, a polyalkoxylated group containing 6 to 20 carbon atoms and optionally containing sulfur or additional oxygen, at least one of which is a hydrocarbyl group, i.e., is not hydrogen, and $R^2$ is a $C_2$ to $C_4$ alkylene group, with a boron compound which may be boric acid, boric oxide, a metaborate, or an alkyl borate of the formula $$(R^5O)_yB(OH)_z$$

wherein y is 1 to 3, z is 0 to 2, their sum being 3, and $R^5$ is an alkyl group containing from 1 to 6 carbon atoms, the improvement comprising thickening said grease with a hydroxy-containing soap thickener. The presence of phosphorus and sulfur moieties provides an even higher dropping point. The alkyl borates include the mono-, di- and trialkyl borates, i.e., those having the methyl, ethyl, propyl, butyl, pentyl, and hexyl groups.

Preferably the amine is overborated. By "overborated" is meant the presence in the borated product of more than a stoichiometric amount of boron.

DESCRIPTION OF SPECIFIC EMBODIMENTS

The borated amines of the invention can be made by reacting an amine of the above formula with a boron compound such as boric oxide, boric acid, an alkyl borate or mixtures of these. The resulting products are believed to be, primarily, borated amines, but other possible products present are metaborates and the like. Included within the scope of the amines as set forth in the above formula are (1) the primary amines such as hexylamine, octylamione, nonylamine, decylamine, dodecylamine, tetradecylamine, octadecylamine, eicosylamine, triacontylamine, oleylamine, stearylamine, isostearylamine, tallowamine and soyamine, (2) the secondary amines corresponding to (1) having both groups the same or having mixtures of such groups, (3) the corresponding tertiary amines where again all the groups in the same molecule can be the same or different and (4) diamines such as N-octyl-1,2-ethylenediamine or the N-octyl-1,3-propylenediamine, N-coco-1,2-ethylenediamine or the N-coco-1,3-propylenediamine, N-oleyl-1,2-ethylenediamine, or N-oleyl-1,3-propylenediamine, N-soya-1,2-ethylenediamine or the N-soya-1,3-propylenediamine and N-tallow-1,2-ethylenediamine or the N-tallow-1,3-propylenediamine. The secondary amines include N-ethyl-N-oleylamine, N-methyl-N-soyamine, and the tertiary amines include N, N-diethyl-N-oleylamine.

Alkoxylated amines included are bis(2-hydroxyethyl) oleylamine, bis(2-hydroxypropyl)oleylamine, bis(2-hydroxyethyl)tallowamine, bis(2-hydroxypropyl)tallowamine, (hydroxyethyl)(hydroxypropyl)tallowamine, polyethoxylated oleylamine (containing 7 ethoxyl groups) and polyethoxylated tallowamine (containing 3 ethoxyl groups). Included also are hydroxylkyl amines made by the ethoxylation or propoxylation of hydrocarbyldiamines or hydrocarbyltriamines. Specifically included are aromatic and alkyl- or alkylene-substituted aromatic groups containing 6 to 30 carbon atoms. Further included are alkoxyalkylamines, such as dodecyloxypropylamine and triisodecyloxypropylamine and similar oxygen-containing amines, and the corresponding alkoxydiamines, such as the N-alkoxyhydrocarbylenediamines.

The reaction to form the borate amine can be carried out at from about 80° C. to about 260° C., preferably from about 110° C. to about 180°. The temperature chosen will depend for the most part on the particular reactants and on whether or not a solvent is used. Reaction pressures can be vacuum, atmospheric or positive pressure. In carrying out this reaction, it is preferable that quantities of reactants be chosen such that the molar ratio of amine to boron compound be from about 0.2 to about 2, preferably from about 0.5 to about 0.9. The amine can be reacted with an excess of the borating species to form a borate amine containing from about 0.1% by weight of boron to as much as 10% or more of boron.

While atmospheric pressure is generally preferred, the reaction can be advantageously run at from about 1 to about 5 atmospheres. Furthermore, where conditions warrant it, a solvent may be used. In general, any relatively non-polar, unreactive solvent can be used, including benzene, toluene, xylene and 1,4-dioxane. Other hydrocarbon and alcoholic solvents, which include propanol, butanol, hexamethylene glycol and the like, can be used. Mixtures of alcoholic and hydrocarbon solvents can be used also.

The times for the reactions are not critical. Thus, any phase of the process can be carried out in from about 1 to about 20 hours.

A narrow class of thickening agents is preferred to make the grease of this invention. Included among the preferred thickening agents are those containing at least a portion of alkali metal, alkaline earth metal or amine soaps of hydroxyl-containing fatty acids, fatty glycerides and fatty esters having from 12 to about 30 carbon atoms per molecule. The metals are typified by sodium, lithium, calcium and barium. Preferred is lithium. Preferred members among these acids and fatty materials are 12-hydroxystearic acid and glycerides and esters containing 12-hydroxystearates, 14-hydroxystearic acid, 16-hydroxystearic acid and 6-hydroxystearic acid.

The entire amount of thickener need not be derived from the aforementioned preferred members. Significant benefit can be attained using as little thereof as about 15% by weight of the total thickener. A complementary amount, i.e., up to about 85% by weight of a wide variety of thickening agents can be used in the grease of this invention. Included among the other useful thickening agents are alkali and alkaline earth metal soaps of methyl-12-hydroxystearate, diesters of a $C_4$ to $C_{12}$ dicarboxylic acid and tall oil or marine oil fatty acids. Other alkali or alkaline earth metal fatty acids containing from 12 to 30 carbon atoms and no free hydroxyl may be used. These include soaps of stearic and oleic acids.

Other thickening agents include salt and salt-soap complexes as calcium stearate-acetate (U.S. Pat. No. 2,197,263), barium stearate acetate (U.S. Pat. No. 2,564,561), calcium, stearate-caprylate-acetate complexes (U.S. Pat. No. 2,999,065), calcium caprylate-acetate (U.S. Pat. No. 2,999,066), and calcium salts and soaps of low-, intermediate- and high-molecular weight acids and of nut oil acids.

Another group of thickening agents comprises substituted ureas, phthalocyamines, indanthrene, pigments such as perylimides, pyromellitdiimides, and ammeline, as well as certain hydrophobic clays. These thickening agents can be prepared from clays which are initially hydrophilic in character, but which have been converted into a hydrophobic condition by the introduction of long-chain hydrocarbon radicals into the surface of the clay particles prior to their use as a component of a grease composition, as, for example, by being subjected to a preliminary treatment with an organic cationic surface active agent, such as an onium compound. Typical onium compounds are tetraalkylammonium chlorides, such as dimethyl dioctadecyl ammonium chloride, dimethyl dibenzyl ammonium chloride and mixtures thereof. This method of conversion, being well known to those skilled in the art, is believed to require no further discussion, and does not form a part of the present invention.

Manufacture of the thickening agents can be done in a variety of grease making equipment such as in open kettles at reduced, atmospheric, or positive pressures; in higher pressure reaction chambers which may be operated to as high as 180 psig; or in continuous manufacturing equipment. The temperature range from the bulk grease under manufacture can range from 15° C. (60° F.) to 238° C. (460° F.).

The third member(s) that may be present in the grease composition are the phosphorus and sulfur moieties. Both of these can be present in the same molecule, such as in a metal or non-metal phosphorodithioate of the formula

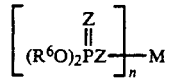

wherein $R^6$ is a hdyrocarbyl group containing 3 to 18 carbon atoms, M is a metal or non-metal, n is the valence of M and Z is oxygen or sulfur, at least one Z being sulfur.

In this compound, $R^6$ is preferably an alkyl group and may be a propyl, butyl, pentyl, hexyl, octyl, decyl, dodecyl, tetradecyl or octadecyl group, including those derived from propanol, isopropanol, butanol, isobutanol, sec-butanol, 4-methyl-2-pentanol, 2-ethylhexanol, oleyl alcohol, and mixtures thereof. Further included are alkaryl groups such as butylphenyl, octylphenyl, nonylphenyl and dodecylphenyl groups.

The metals covered by m include those in Groups IA, IIA, IIB and VIII of the Periodic Table. Some that may be mentioned are lithium, molybdenum, sodium, calcium, zinc, cadmium, silver and gold. Non-metallic ions include organic groups derived from vinyl esters such as vinyl acetate, vinyl ethers such as butyl vinyl ether, epoxides such as propylene oxide and 1,2-epoxydodecane and amine salts. They also include other nitrogenous compounds such as those derived from hydrocarbyl amines and diamines, including oleylamine and N-oleyl-1,3-propylenediamine and such as the imidazolines and oxazolines.

The phosphorus and sulfur can also be supplied from the combination of two separate compounds, such as the combination of (1) a dihydrocarbyl phosphite having 2 to 10 carbon atoms in each hydrocarbyl group or mixtures of phosphites and (2) a sulfide such as sulfurized isobutylene, dibenzyl disulfide, sulfurized terpenes, phosphorodithionyl disulfide and sulfurized jojoba oil. The phosphites embrace the dibutyl, dihexyl, dioctyl, didecyl and similar phosphites. Phosphate esters containing 4 to 20 carbon atoms in each hydrocarbyl group, such as tributyl phosphate, tridecyl phosphate, tricresyl phosphate and mixtures of such phosphates, can also be used.

In summary, it is essential to the practice of this invention, in which greases having vastly improved dropping points are obtained, that at least the first two of the above-mentioned ingredients be formulated into the composition. Thus:

first, with respect to the preparation of the grease, the thickener will have at least about 15% by weight of a metal or non-metal hydroxy-containing soap therein, the total thickener being from about 3% to about 20% by weight of the total grease composition;

second, there will be added to the grease from about 0.01% to about 10% by weight, preferably about 0.1% to about 2%, of the borated amine, in which the borated amine preferably has been reacted with at least an equimolar amount of a boron compound; and as a third component, the composition may have therein from 0.01% to about 10% by weight preferably, from 0.2% to 2% by weight of phosphorus- and sulfur-containing compounds or a mixture of two or more compounds which separately supply the phosphorus and sulfur moieties. If separate compounds are used, an amount of the mixture equivalent to the above concentration levels is used to supply desired amounts of phosphorus and sulfur.

It was noted that, when the hydroxy-containing thickener was used with the borated amine, the dropping point of the grease was consistently unexpectedly higher than with a grease from the same grease vehicle and the same borated amine, but with a different thickener, e.g., a non-hydroxy-containing thickener. Thus, the broad invention is to a grease composition comprising the two components mentioned.

In general, the reaction products of the present invention may be employed in any amount which is effective for imparting the desired degree of friction reduction, antiwear activity, antioxidant activity, high temperature stability or antirust activity. In many applications, however, the borated amine and the phosphorus- and/or sulfur-containing compound(s) are effectively employed in combined amounts of from about 0.02% to about 20% by weight, and preferably from about 0.2% to about 4% of the total weight of the composition.

The greases of the present invention can be made from either a mineral oil or a synthetic oil, or mixtures thereof. In general, mineral oils, both paraffinic, naphthenic and mixtures thereof, may be of any suitable lubricating viscosity range, as for example, from about 45 SSU at 100° F. to about 6000 SSU at 100° F., and preferably from about 50 to about 250 SSU at 210° F. These oils may have viscosity indexes ranging to about 100 or higher. Viscosity indexes from about 70 to about 95 are preferred. The average molecular weights of these oils may range from about 250 to about 800. In making the grease, the lubricating oil from which it is prepared is generally employed in an amount sufficient to balance the total grease composition, after accounting for the desired quantity of the thickening agent, and other additive components to be included in the grease formulation.

In instances where synthetic oils are desired, in preference to mineral oils, various compounds of this type may be successfully utilized. Typical synthetic vehicles include polyisobutylene, polybutenes, hydrogenated polydecenes, polypropylene glycol, polyethylene glycol, trimethylol propane esters, neopentyl and pentaerythritol estes, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl) ether, phenoxy phenylethers.

The metallic soap grease compositions containing one or more of the borated amines, and optionally, one or more of the sulfur and phosphorus combinations described herein provide advantages in increased dropping point, improved grease consistency properties, antirust characteristics and potential antifatigue, antiwear and antioxidant benefits unavailable in any of the prior greases known to us. The grease of this invention is unique in that it can be preferably manufactured by the admixture of additive quantities of the alcohol borates to the fully formed soap grease after completion of saponification.

The following Examples will present illustrations of the invention. They are illustrative only, and are not meant to limit the invention.

EXAMPLE 1

A mixture of 1295 g N-oleyl-1,3-propylenediamine (obtained as Duomeen O from Armak Chemical Co.), 218 g of xylene, 437 g of n-butanol, 658 g of hexamethylene glycol and 1210 g of boric acid were placed in a reactor equipped with heater, agitator and Dean-Stark tube with condenser, and refluxed for about 10 hours until all water formed in the reaction azeotroped over (maximum temperature was about 195° C.). The solvents were removed by vacuum distillation at 195° C. and the product was filtered and then diluted with an equal amount of 100 second process oil to form a 50% concentrate of borated diamine in mineral oil. The concentrate was an orange colored viscous liquid.

EXAMPLE 2

N-tallow-1,3-propylenediamine was obtained as Duomeen T from Armak Chemical Co. and borated with boric acid as generally described in Example 1. For convenience of handling the borated N-tallow-1,3-propylenediamine was blended with an equal wt. of 100 second process oil to form a 50% concentrate in mineral oil.

EXAMPLE 3

A lithium hydroxystearate grease thickener was prepared by saponification of a mixture containing 12-hydroxystearic acid (8%) and the glyceride thereof (9%) with lithium hydroxide in a mineral oil vehicle at about 177° C. in a closed contactor.

EXAMPLE 4

After depressuring and dehydration of the thickener in an open kettle sufficient mineral oil was added to reduce the thickener content to about 9.0%. After cooling to about 99° C., a typical grease additive package, consisting of an amine antioxidant, phenolic antioxidant, metallic dithiophosphate (1.5 wt % of zinc dialkyl phosphorodithioate, where the alkyl is derived from a mixture of $C_3$ to $C_6$ primary alcohols), sulfur-containing metal deactivator and nitrogen containing antirust additives, was added.

EXAMPLE 5

To the base grease of Example 4, was added at about 110° C., 0.5 wt % of the borated N-oleyl-1,3-propylenediamine of Example 1.

EXAMPLE 6

To the base grease of Example 4 was added, at about 115° C., 1.0 wt % of the borated N-tallow-1,3-propylenediamine of Example 2.

EXAMPLE 7

To the base grease of Example 3 was added 0.5 wt. % of the borated N-oleyl-1,3-propylenediamine of Example 1.

EXAMPLE 8

Same as Example 7, except 2% of borated amine was used.

EXAMPLE 9

Base grease thickened with the lithium soap of 50/50 (wt) mixture of stearic and palmitic acids, which are non-hydroxy-containing thickeners.

EXAMPLE 10

50 wt. % of the base grease used in Example 4 plus 50 wt. % of the grease of Example 9, producing a 50-50 mixture of hydroxy- and non-hydroxy-containing thickeners.

EXAMPLE 11

Base grease of Example 9 containing 2 wt. % of the borated amine of Example 2.

Results obtained in the ASTM D2265-78 grease dropping point test are shown in the following table.

TABLE 1

| SAMPLE | D2265 Dropping Point, °C. |
|---|---|
| Example 3 | 199 |
| Example 4 | 200 |
| Example 5 | 310 |
| Example 6 | 300 |
| Example 7 | 236 |
| Example 8 | 258 |
| Example 9 | 209 |
| Example 10 | 190 |
| Example 11 | 207 |

Examples 5 and 6 show a significant effect upon dropping point improvement when borated amine is added to hydroxy-containing carboxylate soap thickened grease in the presence of a phosphorus and sulfur source.

Examples 7 and 8 show a significant effect upon hydroxy-containing carboxylate soap thickened grease when the borated amines described are used.

Examples 9, 10 and 11 clearly show no benefit of the borated amine upon the dropping point of a non-hydroxyl-containing carboxylate soap thickened grease.

We claim:

1. An improved grease composition comprising a major proportion of (1) a grease, (2) from about 0.01% to about 10% by weight of a means for increasing the dropping point of the grease composition comprising a reaction product made by reacting N-oleyl-1,3-propylenediamine with boric acid, (3) a thickener containing at least about 15% by weight of a 12-hydroxystearate thickener, and (4) a compound containing both phosphorus and sulfur supplied by a zinc $C_3$ to $C_6$ alkyl phosphorodithioate compound.

2. An improved grease composition comprising a major proportion of (1) a grease, (2) from about 0.01% to about 10% by weight of a means for increasing the dropping point of the grease composition comprising a reaction product made by reacting N-tallow-1,3-propylenediamine with boric acid, (3) a thickener containing at least about 15% by weight of a lithium 12-hydroxystearate thickener, and (4) a compound containing both phosphorus and sulfur moieties supplied by a zinc $C_3$ to $C_6$ alkyl phosphorodithioate compound.

* * * * *